US006962116B2

(12) United States Patent
Bienick et al.

(10) Patent No.: US 6,962,116 B2
(45) Date of Patent: Nov. 8, 2005

(54) REFRIGERATOR COMPARTMENT HOUSING VERTICALLY ADJUSTABLE SHELVES

(75) Inventors: Craig Bienick, Jenison, MI (US); Vincent L. Ramik, Annandale, VA (US)

(73) Assignee: Gemtron Corporation, Sweetwater, TN (US)

( * ) Notice: Subject to any disclaimer, the term of this patent is extended or adjusted under 35 U.S.C. 154(b) by 245 days.

(21) Appl. No.: 10/355,136

(22) Filed: Jan. 31, 2003

(65) Prior Publication Data

US 2004/0149182 A1 Aug. 5, 2004

(51) Int. Cl.[7] ..... A47B 9/00
(52) U.S. Cl. ..... 108/108; 108/147.17; 312/408
(58) Field of Search ..... 108/106, 107, 108/108–110, 147.16, 147.17; 211/187, 193; 248/241, 243–246; 312/408, 410

(56) References Cited

U.S. PATENT DOCUMENTS

| | | | | |
|---|---|---|---|---|
| 569,640 | A | 10/1896 | Hartzell | |
| 984,857 | A | 2/1911 | Schuftan | |
| RE19,798 | E | 12/1935 | Copeman | |
| 2,841,459 | A | 7/1958 | Sharpe | |
| 3,172,715 | A | 3/1965 | Powder | |
| 3,299,839 | A | 1/1967 | Nordbak | |
| 3,316,044 | A | 4/1967 | Carbary | |
| 3,479,974 | A | 11/1969 | Ferdinand et al. | |
| 3,536,015 | A | 10/1970 | Textoris | |
| 3,702,137 | A | 11/1972 | Evans | |
| 3,834,659 | A | 9/1974 | Siegel | |
| 3,888,440 | A | 6/1975 | Rebentisch | |
| 4,250,815 | A | 2/1981 | Swanson | |
| 4,934,645 | A * | 6/1990 | Breslow | 248/242 |
| 5,088,607 | A * | 2/1992 | Risafi et al. | 211/187 |
| 5,441,338 | A * | 8/1995 | Kane et al. | 312/408 |
| 5,735,222 | A * | 4/1998 | Webb | 108/110 |
| 5,913,584 | A * | 6/1999 | Swindell et al. | 312/408 |
| 5,921,411 | A * | 7/1999 | Merl | 108/108 |
| 6,065,821 | A | 5/2000 | Anderson et al. | |
| 6,168,032 | B1 * | 1/2001 | Merl | 248/242 |
| 6,196,141 | B1 | 3/2001 | Herron, III et al | |
| 6,227,636 | B1 | 5/2001 | Lye et al. | |
| 6,584,916 | B1 * | 7/2003 | Felton et al. | 108/107 |
| 6,675,725 | B2 * | 1/2004 | Felton et al. | 108/107 |
| 2002/0027115 | A1 * | 3/2002 | Gay el at. | 211/187 |

FOREIGN PATENT DOCUMENTS

| | | | | |
|---|---|---|---|---|
| CH | 665759 | * | 9/1988 | 108/110 |
| EP | 0235448 | * | 9/1987 | 108/108 |

* cited by examiner

*Primary Examiner*—Janet M. Wilkens
*Assistant Examiner*—Hanh V. Tran
(74) *Attorney, Agent, or Firm*—Diller, Ramik & Wight

(57) ABSTRACT

A shelf assembly includes a pair of shelf adapter brackets each defined by first and second shelf bracket members, one of which includes vertically disposed opposing slideways into which open a plurality of vertically spaced slots and the other of which includes a plurality of supporting projections which move in the slideways and seat in the slots to effect selectively vertical adjustment of an associated shelf. The shelf may include shelf brackets having hooks for engaging in slots of one of the bracket members or can be integrally formed to define one of the first and second bracket members. Another embodiment includes a shelf having an injection molded rim with hooks at rear corners thereof for engaging one of the shelf support members. Each shelf assembly prevents inadvertent/accidental disengagement of an associated shelf from the adapter brackets.

60 Claims, 9 Drawing Sheets

FIG. 1
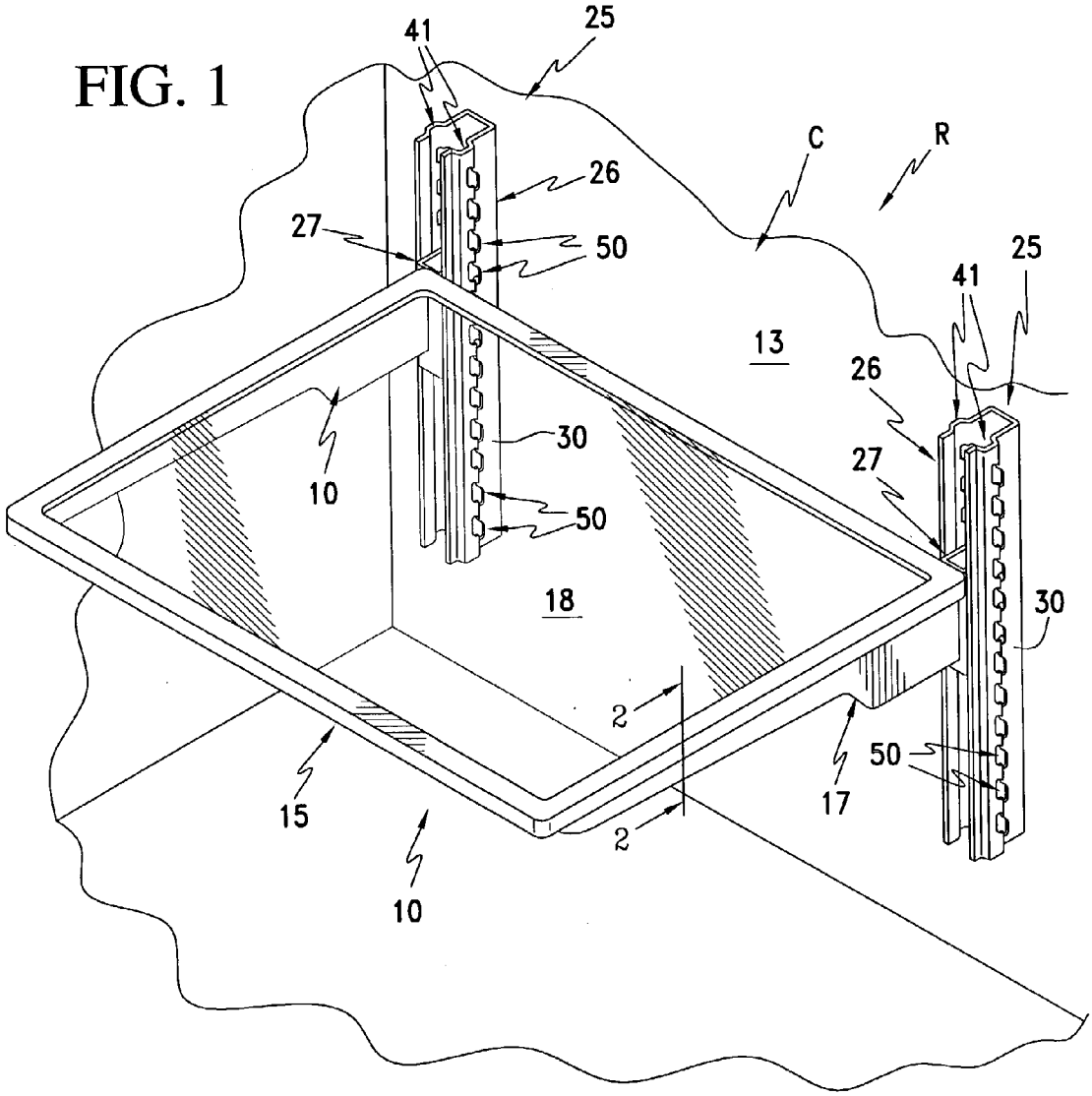
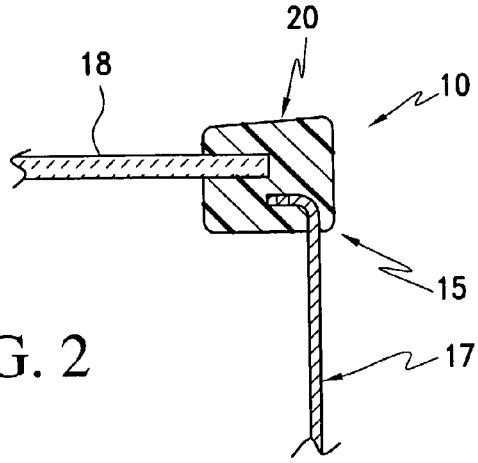
FIG. 2

FIG. 9
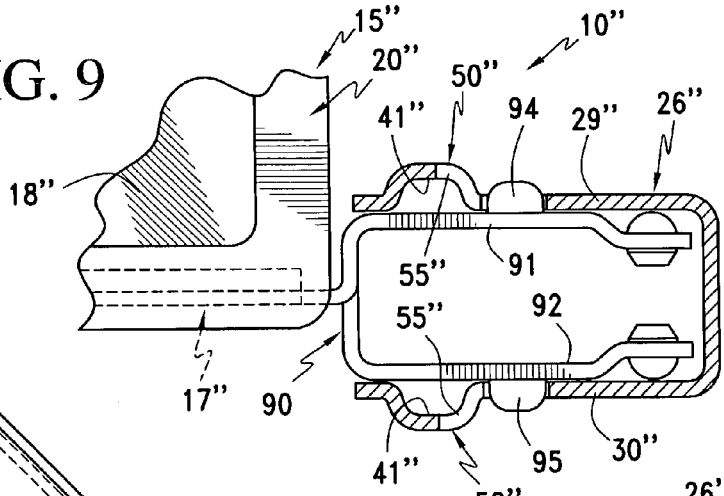
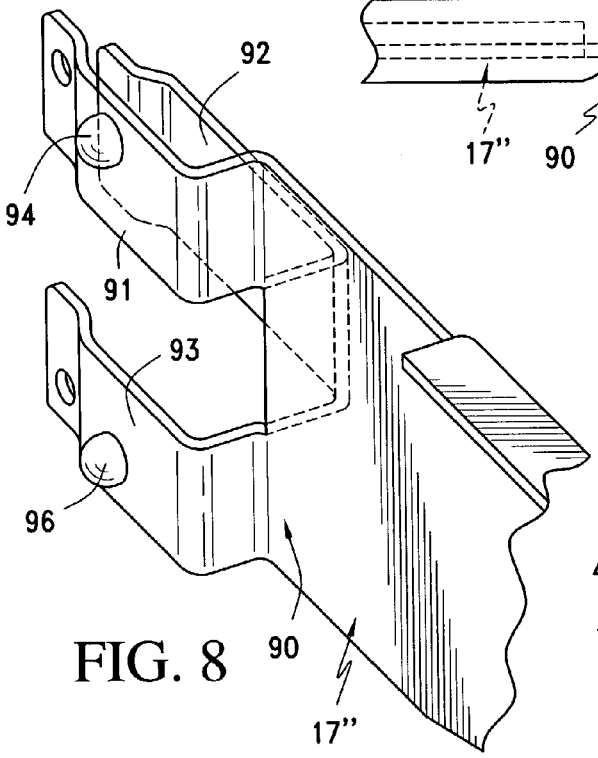
FIG. 8
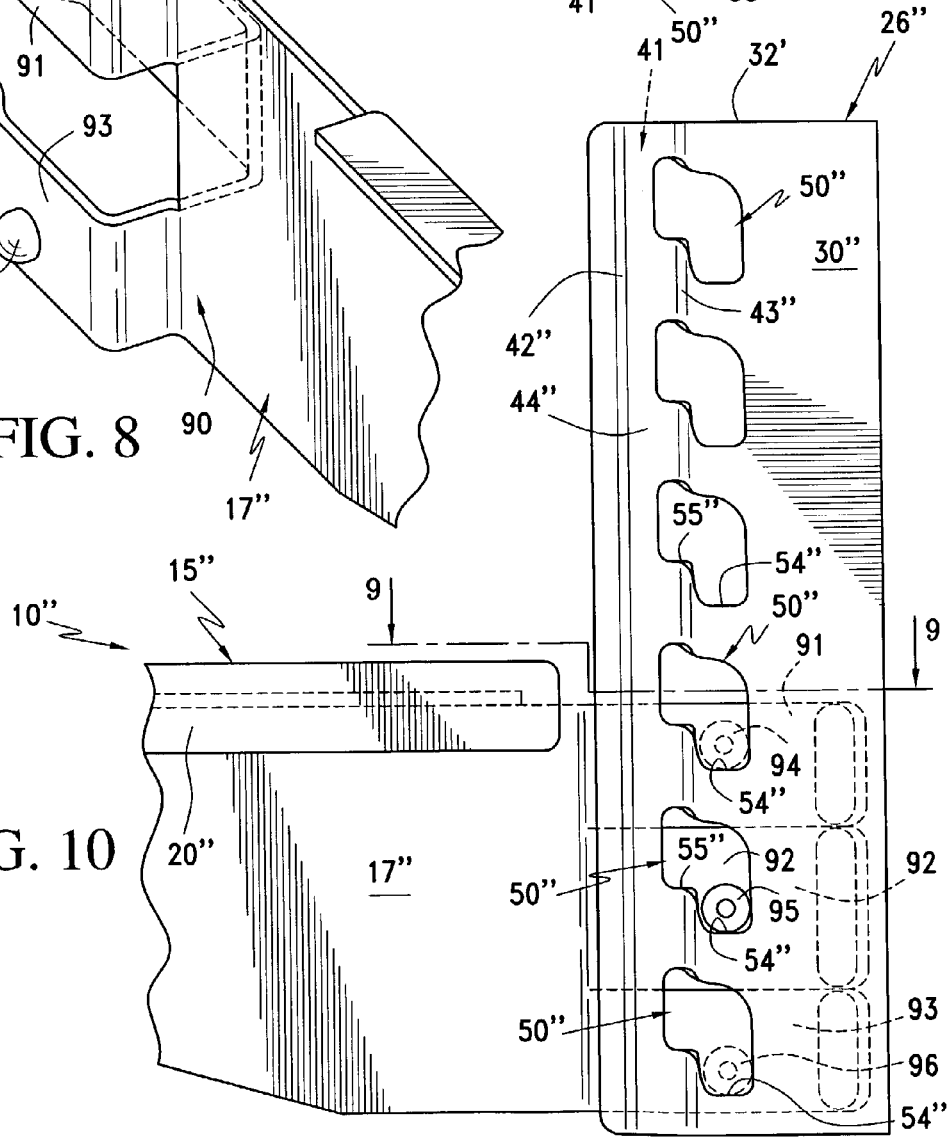
FIG. 10

FIG. 11
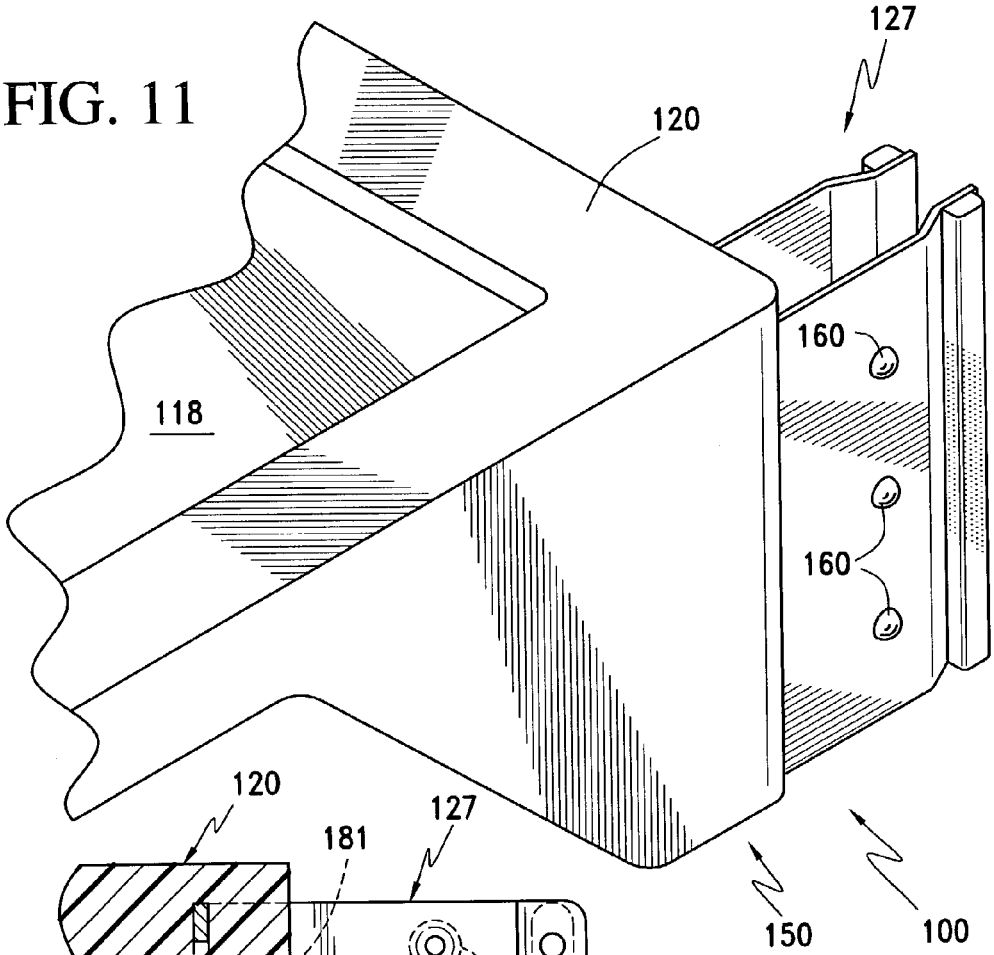
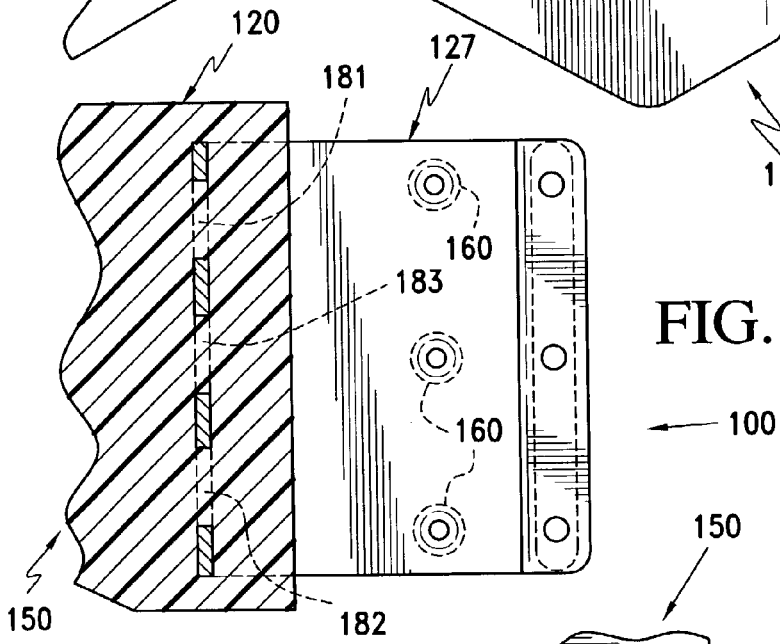
FIG. 13
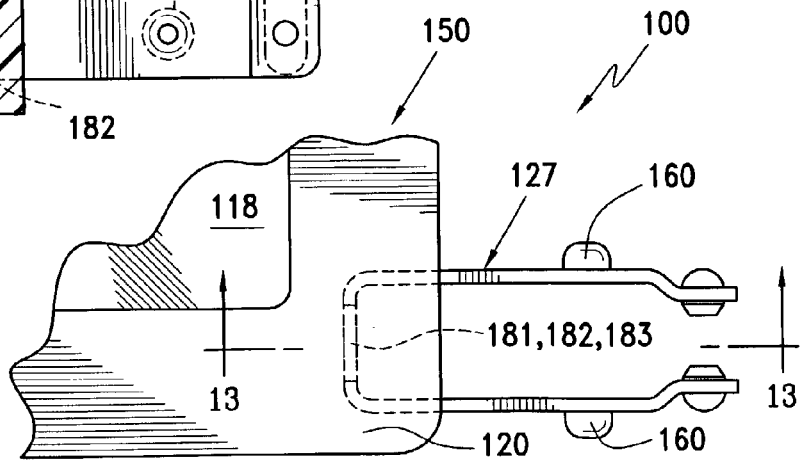
FIG. 12

REFRIGERATOR COMPARTMENT HOUSING VERTICALLY ADJUSTABLE SHELVES

BACKGROUND OF THE INVENTION

This invention relates to shelving particularly for refrigerators, but is equally adapted for utilization in a variety of different environments, such as furniture shelves, cabinet shelves, point-of-sale displays, and the like.

A conventional refrigerator shelf typically includes a substantially planar shelf member, and a pair of metal shelf brackets connected to the shelf member, preferably by an injection molded resinous peripheral encapsulation, rim or border. The support brackets typically include a pair of hooks which are received in pairs of slots carried by vertical shelf supports, channels or tracks secured to or forming an integral portion of a rear wall of a refrigerator compartment. The shelves can be step-adjusted along the vertical supports in a convention manner by hooking and unhooking the shelf brackets relative to the vertical supports or tracks. The latter is readily accomplished when the shelf is devoid of any products/articles. However, if relatively heavy products are supported upon the planar shelf member of the shelf, it is not uncommon for the weight and imbalance of the products to cause the shelf and the products thereon to dislodge and/or drop with attendant damage (breakage, spillage, etc.). At times a cantilevered shelf with articles/products thereon is partially unhooked from the vertical support rails of the refrigerator compartment and tilts or cants which causes the articles/products to slide off the shelf with resultant damage even though the shelf itself does not drop. Therefore, cantilevered shelves which are designed to be step-adjusted relative to shelf tracks or channels provided on the rear wall of a refrigerator are susceptible to damage during adjustment, along with the products/articles supported thereon.

SUMMARY OF THE INVENTION

Accordingly, the present invention provides a refrigerator shelf assembly defined in part by a conventional shelf, namely, a pair of metal support brackets, a planar shelf member, preferably made of clear tempered glass, and an injection molded encapsulation, border or rim unitizing the shelf brackets and the planar shelf member. However, the invention provides a novel adapter bracket utilized in pairs. Each adapter bracket is preferably constructed from metal and includes a first bracket member having front edges along each of which is a slideway or channel into which opens a plurality of vertically spaced slots. The rear of each first bracket member is conventionally secured to the rear wall of a refrigerator compartment. Each second bracket member includes a pair of oppositely projecting projections or supports which are vertically spaced from each other a distance corresponding to the slots in the first member. Moreover, the distance between the ends of the second member projections corresponds substantially to the same distance between the channels and is substantially equal to the maximum distance between support edges defined by the vertical slots of the second member. The latter dimensional relationships permit the shelf bracket first and second members, one of which carries the shelf, to be moved upwardly and downwardly in the slideways or channels without being fully disassembled therefrom thereby precluding inadvertent or accidental disassembly of the shelf from the pair of adapter brackets. The second members preferably include slots into which are hooked hooks of the shelf and remain so attached when the shelf is adjusted vertically upwardly or downwardly by sliding movement of the second members. In this fashion the shelf is never bodily removed from the adapter brackets and the first and second members of the adapter brackets are never bodily disconnected from each other unless done intentionally.

In further accordance with the invention, the projecting supports of the second members and the slideways and slots of the first member are so related that should the shelf be accidentally released when the second member projections are in the slideways, the weight of the cantilevered shelf, with or without products/articles thereon, tilts or cants the cantilevered shelf forwardly and downwardly which automatically introduces a lowermost of the second member projections into associated slots of the first member which bottom against support edges of the slots and automatically lock the cantilevered shelf in the position of a slight forward tilt. In this manner the entire shelf and the articles/products supported thereon will not drop and most, if not all, products/articles will be retained upon the glass shelf member thereof.

The novel shelf assembly and the pair of shelf adapter brackets associated therewith thereby effect limited vertical sliding movement to space shelves different vertical distances from each other but permit the latter to be accomplished without bodily or entirely disconnecting the shelf from the adapter brackets and the adapter brackets from the refrigerator compartment. The latter, with the automatic locking feature latter described, virtually eliminates inadvertent/accidental shelf, shelf assembly, product and/or article breakage or damage during vertical shelf adjustment.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view of a refrigerator, a refrigerator compartment thereof and a novel shelf assembly of the invention defined by a shelf having an injection molded encapsulation or rim unitizing a tempered glass shelf member to a pair of metal shelf support brackets, and a pair of shelf adapter brackets each defined by first and second bracket members, each of the first bracket members being secured to a rear wall of the refrigerator compartment and having opposing slideways and a plurality of vertically spaced slots therein, and a second bracket member having oppositely directed projecting supports received in the slots and additionally having slits or slots receiving hooks of the metal shelf support brackets.

FIG. 2 is an enlarged fragmentary cross-sectional view taken generally along line 2—2 of FIG. 1, and illustrates the injection molded rim encapsulating and unitizing a peripheral edge of the glass shelf member and an upper edge of one of the metal shelf support brackets.

FIG. 8 is fragmentary perspective view of a shelf bracket constructed in accordance with this invention, and illustrates as an integral part thereof a rear member in the form of a second shelf bracket member carrying oppositely directed supporting projections.

FIG. 9 is a fragmentary cross-sectional view taken generally along line 9—9 of FIG. 10, and illustrates the shelf bracket having a glass panel member unitized thereto by an injection molded rim or encapsulation and the oppositely directed supporting projections thereof seated in slots of an associated first shelf bracket member conventionally secured to a wall of the refrigerator compartment.

FIG. 10 is a fragmentary side elevational view of the shelf and shelf adapter bracket of FIG. 9, and illustrates the interlocked relationship between the first and second shelf bracket members thereof to achieve desired vertical adjustment.

FIG. 11 is a top perspective view of another shelf adapter bracket of the present invention and illustrates one of the second shelf bracket members of FIG. 1 integrally unitized to a shelf by an injection molded encapsulation or rim at a reinforced corner thereof.

FIG. 12 is a fragmentary top plan view looking downwardly in FIG. 11, and illustrates oppositely directed projecting supports of the second shelf bracket member.

FIG. 13 is an enlarged fragmentary cross-sectional view taken generally along line 13—13, and illustrates the manner in which the shelf bracket member is unitized to the shelf by the injection molded encapsulation or rim at the corner thereof.

DESCRIPTION OF THE PREFERRED EMBODIMENTS

Figure 3:
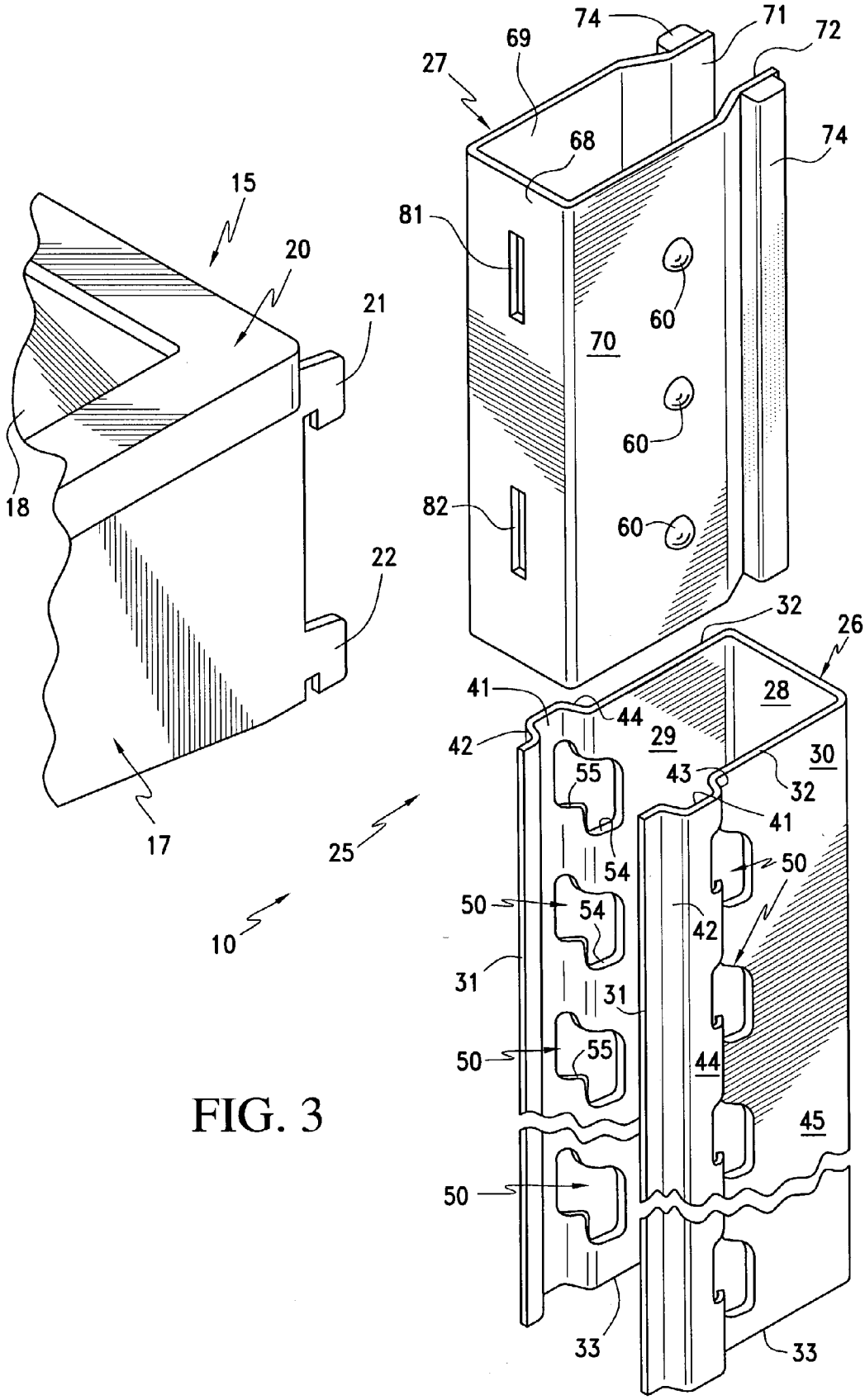
FIG. 3 is a fragmentary exploded view of one of the shelf adapter brackets, and illustrates details of the slideways and slots of the first shelf bracket member, oppositely directed projecting supports and slits of the second shelf bracket member and hooks of the shelf.

A novel refrigerator shelf assembly constructed in accordance with the present invention is generally designated by the reference numeral 10, and is illustrated in FIG. 1 in association with a cabinet or compartment C of a refrigerator R.

The shelf assembly 10 includes a shelf 15 defined by opposite substantially parallel metal shelf brackets 16, 17 unitized to a peripheral edge (unnumbered) of a shelf member 18 of tempered glass by an injection molded encapsulation, rim or border 20 (FIG. 2) formed in accordance with the method disclosed in U.S. Pat. No. 5,362,149 granted on Nov. 8, 1994 to Bird et al., the totality of which is incorporated hereat by reference. Each of the metal support brackets 16, 17 includes conventional downwardly directed hooks 21, 22 which normally engage in vertically disposed parallel shelf tracks in a conventional refrigerator compartment, as is fully disclosed in the latter-identified patent. Such conventional shelves 10 can be hooked to, completely unhooked from and re-hooked to the slots of the shelf tracks to effect step-wise vertical adjustments of the shelves relative to other shelves and/or top and bottom walls of an associated refrigerator compartment. However, a disadvantage of such total disconnection noted earlier herein between conventional shelf hooks and conventional vertical shelf tracks can result in advertent or accidental shelf and/or product droppage and result in damage or breakage. The latter is precluded by the novel refrigerator shelf assembly 10 of the present invention.

Figure 4:
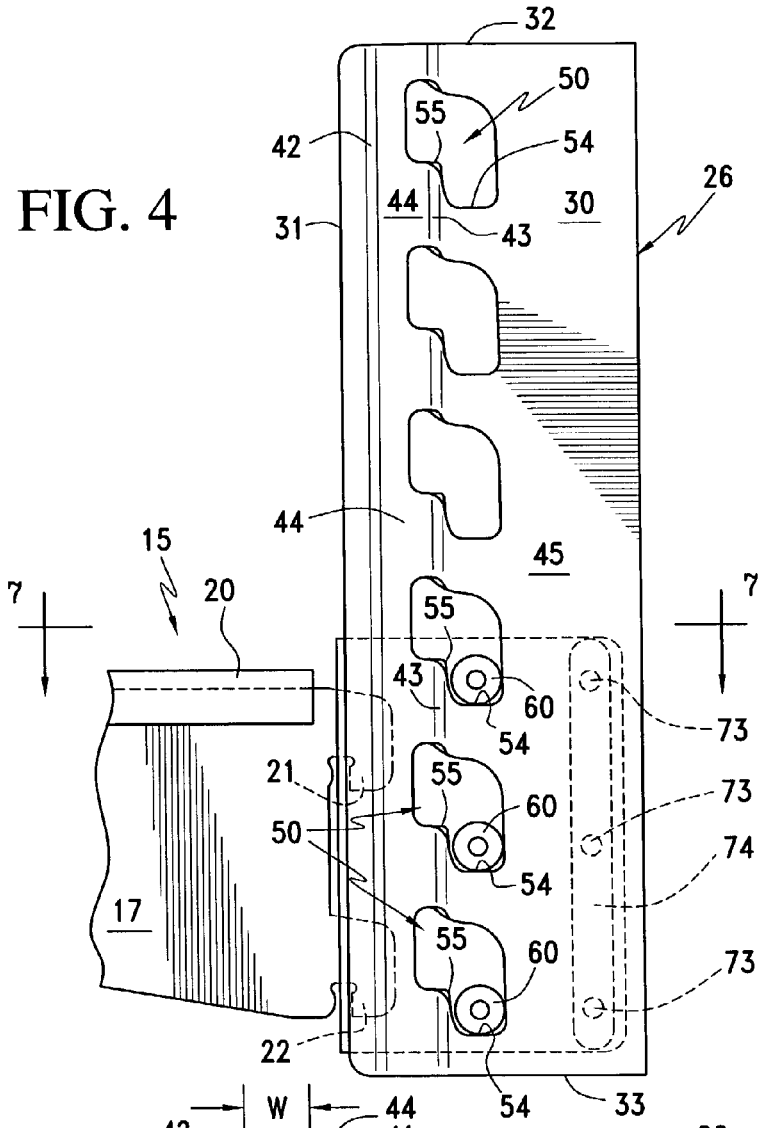
FIG. 4 is a fragmentary side elevational view of one of the shelf adapter brackets, and illustrates the manner in which the oppositely directed projections of the second shelf bracket member are seated in the slots of the first shelf bracket member and hooks of the shelf support brackets are received in slits of the second shelf bracket member.
Figure 5:
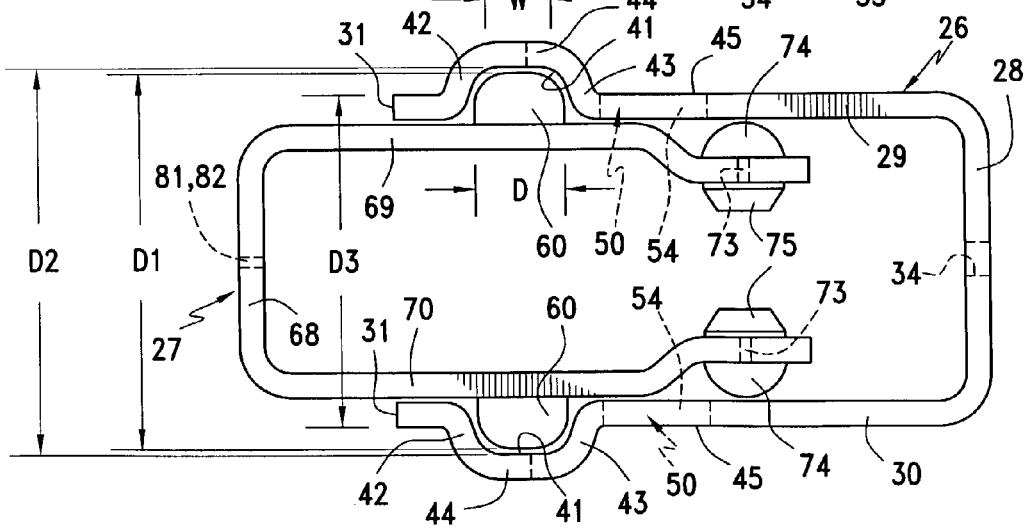
FIG. 5 is an enlarged top plan view of each shelf adapter bracket of FIG. 1, and illustrates the manner in which the projecting supports of the second shelf bracket member slide in the slideways of the first shelf bracket member to effect vertical sliding adjustment therebetween.
Figure 6:
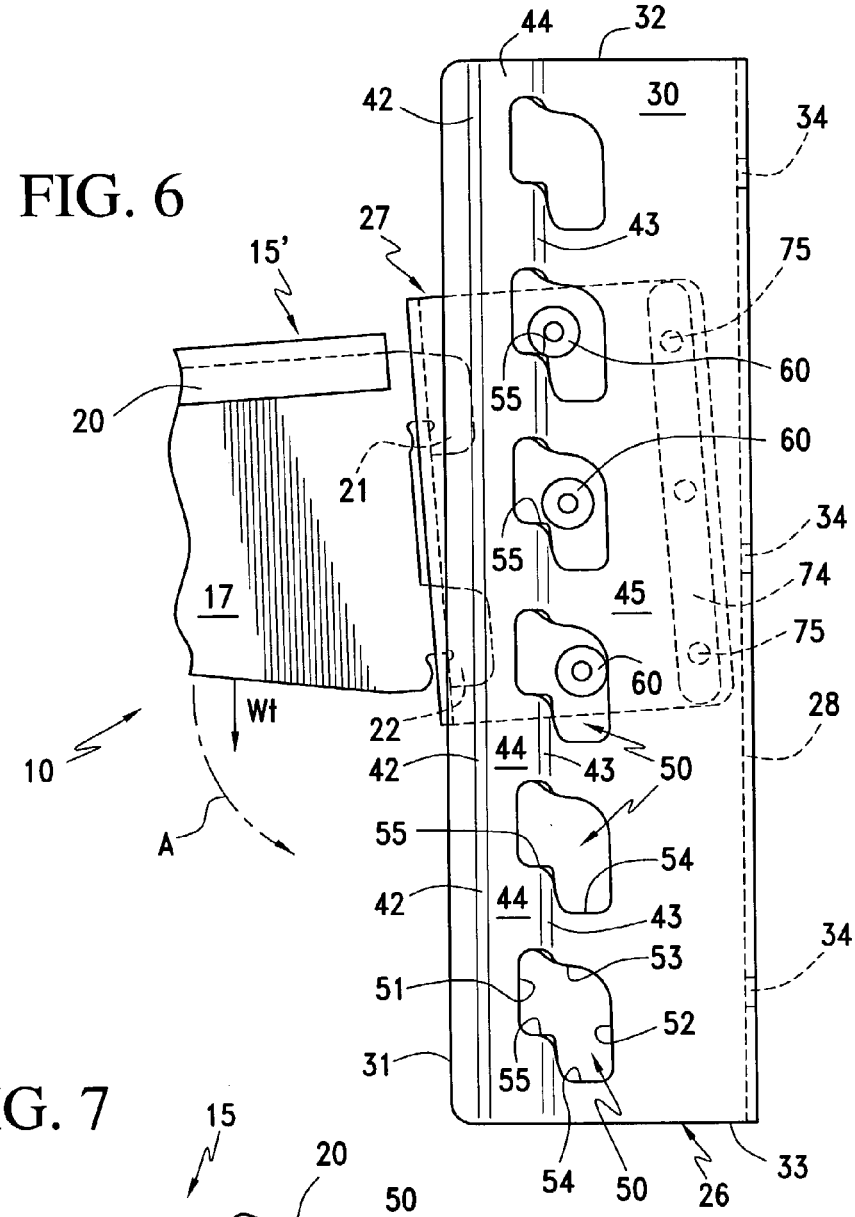
FIG. 6 is a side elevational view of the shelf adapter bracket of FIG. 4, and illustrates the manner in which the shelf will automatically lock in a slightly inclined or canted position if inadvertently or accidentally released or dropped when the projecting supports of the second shelf bracket member are in the slideways of first shelf bracket member.

The shelf assembly 10 further includes a pair 25, 25 (FIG. 1) of identical shelf adapter brackets, each defined by a first shelf bracket member 26 and a second shelf bracket member 27 (FIGS. 3–5). Each first shelf bracket member 26 of the pair 25, 25 of shelf bracket adapters is of a generally U-shaped transverse cross section (FIGS. 5 and 7) and is preferably constructed of relatively rigid metallic sheet material stamped, blanked and formed to the specific configuration best illustrated in FIG. 3 of the drawings. Each U-shaped first bracket member includes a bight wall or bight portion 28 and opposite legs or leg portions 29, 30. Each leg 29, 30 includes a relatively straight front edge or edge portion 31, a top edge or edge portion 32 and a bottom edge or edge portion 33. The bight portion or wall 28 has a plurality of openings 34 (FIGS. 5, 6 and 7) for securing each of the first bracket members 26, 26 to a rear wall 13 of the refrigerator compartment C, as is readily apparent in FIG. 1 of the drawings.

Each of the legs 29, 30 of each of the first shelf bracket members 26, 26 is provided with a vertical slideway or channel 41 immediately adjacent each front edge 31 and substantially parallel thereto. Each slideway 41 is of a generally U-shaped transverse cross section (FIGS. 3, 5 and 7) and is defined by a first leg or leg portion 42 most adjacent each front edge 31, a second leg or leg portion 43 and a bight portion 44 therebetween. The legs or leg portions 42, 43 are in diverging relationship to each other in a direction away from the bight portion 44. Each slideway or channel 41 includes a narrowest transverse width W which increases in the opening direction of the slideways 41, 41. Each leg portion 43 also blends with a medial portion 45 (FIGS. 3–7) of each of the legs 29, 30.

A plurality of identical vertically spaced support means 50 in the form of slots or openings 50 are formed along the length of the medial portion 45 of each of the legs 29, 30 between the upper edge 32 and the lower edge 33 thereof. Each slot 50 includes a front vertical edge 51, a rear vertical edge 52 and a slightly curved top edge 53. The edges 51, 52 are substantially parallel to each other and are parallel to the front edge 31 of the associated legs 29, 30. A lower edge or ledge of each slot 50 includes a lowermost substantially horizontally disposed edge or ledge 54 defining means for supporting projecting supports or projections 60 of each of the second bracket members 27, as will be described more fully hereinafter. A curved transition edge or ledge 55 extends from each edge 51 to each edge 54 beginning at a point midway in the bight portion 44 of each slideway 41, continuing along the ledge portion 43 and ending at a merge point (unnumbered) with the supporting ledge or edge 54 (FIGS. 3–7).

The purpose and function of the transition edges or ledges 55 of the legs 29, 30 of each of the first shelf bracket members 26 is to permit the projecting supports, projections or pins 60 of the second shelf bracket members 27 ready entry from the associated slideways 41, 41 toward and downwardly upon the support edges or ledges 54 of the slots 50 and the like ready removal thereof in an opposite direction for purposes of assembling or vertically slidably adjusting the shelf 15 relative to the first bracket members 26 by sliding the second bracket members 27 vertically relative thereto.

Figure 7:
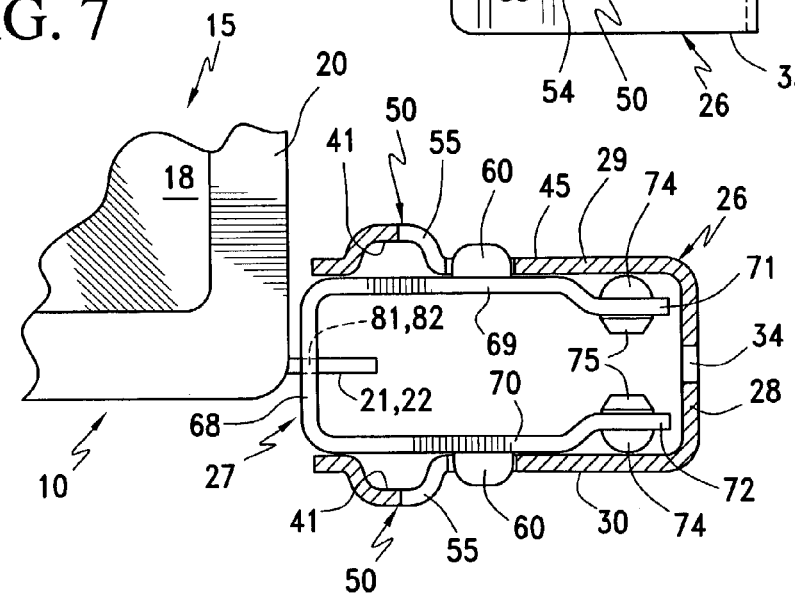
FIG. 7 is a fragmentary cross-sectional view taken generally along line 7—7 of FIG. 4, and illustrates one of the shelf adapter brackets in the adjusted and locked position thereof.

As is best illustrated in FIGS. 3 through 5 of the drawings, the second shelf bracket member 27 of each of the pairs 25, 25 of adapter brackets is also of a generally U-shaped transverse cross-sectional configuration, and is preferably also constructed of relatively rigid sheet metal material blanked, stamped and formed to the configuration best illustrated in FIGS. 3 and 5 of the drawings. Each second shelf bracket member 27 includes a bight wall 68 and oppositely substantially parallel legs 69, 70 which converge toward each other and terminating in substantially parallel end edges or edge portions 71, 72, respectively. The end edges 71, 72 each have a plurality of vertically spaced openings 73 (FIGS. 4 and 5) through which injected polymeric/copolymeric plastic material can pass during the formation of slide members 74 (FIG. 3) on outer surfaces (unnumbered) of the terminal end portion 71, 72 and enlarged heads 75 (FIG. 5) on inboard surfaces (unnumbered) of the terminal edges 71, 72. Slots 81, 82 (FIGS. 3 and 5) are formed in the bight wall 86 of each second shelf bracket member 27 for receipt therein of the hooks 21, 22 of the shelf 15. The pins or projections 60 have a maximum diameter D (FIG. 5) increasing from the narrowest transverse width W of the slideways 41, 41 to the maximum width thereof to permit relative vertical sliding movement therebetween during which the glide members 74, 74 engage inner surfaces (unnumbered) of the legs 29, 30 of the first bracket members 26, as is best illustrated in FIGS. 5 and 7 of the drawings.

As is best illustrated in FIG. 5 of the drawings, the oppositely projecting pins 60, 60 carried by each second shelf bracket member 27 are spaced from each other a maximum effective distance D1 which is slightly less than an effective distance D2 measured between the bight portions 44 of the slideways 41. Because of the slight difference in the distances D1, D2, the projecting pins or projecting supports 60 move readily easily vertically upwardly and downwardly within the slideways 41. Therefore, during initial installation after each of the first bracket members 26, 26 has been secured to the rear wall 13 of the refrigerator compartment C with the slots 50, 50 thereof in horizontal alignment, the pins 60 can be introduced into the slideways 41 from above or below. This can be done by first hooking the hooks 21, 22 into the respective slots 81, 82 of the second shelf bracket members 27 and thereafter simultaneously introducing the latter from the bottom or from the top into the first shelf bracket members 26, 26. Alternately, the shelf 15 need not be connected through its hooks 21, 22 to the slots 81, 82 of the second shelf bracket members 27 but instead the latter can be individually or simultaneously introduced into the first bracket members 26 via the slideways 41 and when horizontally aligned, the second shelf bracket members 27 are simply pushed inwardly in a direction toward the bight walls 28 of the first shelf bracket members 26. As the second shelf bracket members 26 are pushed inwardly, the projecting pins 60 thereof engage and are guided downwardly by the upper edges 53 and/or by the lower edges 55 of a pair of the slots 50. Since the slideways 41, 41 of each of the first bracket members 26, 26 oppose each other, the leg portions 43 thereof are in converging relationship to each other in a direction away from the front edges 31, 31 of the legs 29, 30 and toward the bight wall 28 (FIG. 5). Therefore, during the inward movement of the supporting pins 60 from within the slideways 41 (FIG. 5), the pins 60 move along the converging edges or ledges 55 of the converging walls 43, 43 (FIG. 5) progressively inward from the outermost distance D2, measured across the bight walls 44, 44 of the slideways 41, 41 to a distance D3 (FIG. 5) which is the maximum distance between the horizontally adjacent supporting edges 54. In this manner the transition edges 55, 55 (FIG. 7) of horizontally adjacent slots 50, 50 in the legs 29, 30 of each of the first shelf bracket members 26, 26 contact and guide the associated pins 60, 60 from the slideways 41, 41 toward and upon the supporting edges 54 (FIGS. 4 and 7) and conversely away from the supporting edges 54 and into the slideways 41 for disassembly purposes.

It is to be particularly noted that during any of the vertical adjustment just described of the shelf 15 when attached to the second shelf bracket members 27, 27, and specifically during the movement of the latter along the slots 50 and the slideways 41, there is no total or complete disassembly of the shelf 15 relative to the second shelf bracket members 27 or any total disassembly of the second shelf bracket members 27 relative to the first shelf bracket members 26. Therefore, during vertical adjustment of the shelf 15, when connected to the second shelf bracket members 27, it is extremely unlikely that the shelf 15, with or without products/articles thereon, will be inadvertently dropped or tilted because during any such adjusting movement the projecting pins 60, 60 are at all times in contact with portions of the first shelf bracket members 26, be it through the slots 50, 50 or the slideways 41, 41 thereof. It is only upon moving the projecting pins 60 upwardly or downwardly along their associated slideways 41 that the shelf 15 can accidentally drop substantially vertically if released, and only upon the removal of all three projecting pins 60 from each slideway 41 could the shelf 15 drop to the bottom of the compartment C, though the latter is virtually impossible for reasons explained immediately hereinafter Reference is made to FIG. 6 of the drawings which illustrates the position of the shelf 15' after it has been introduced from above by inserting each second shelf bracket member 27, 27 into an associated first bracket member 26, 26 with the projecting pins 60 disposed in the slideways 41. With the uppermost pins 60, 60 of each second shelf bracket member 27 are immediately adjacent the upper edges 32 of each first shelf bracket members 26, it is assumed that the shelf 15' is accidentally released/dropped. Since the shelf 15' is cantilevered, even absent products or articles supported thereon, its weight Wt (FIG. 6) will effect downward movement and vertical pivoting and/or tilting movement. In other words if the shelf 15' were released from the uppermost assumed position, it would begin to fall vertically because of gravity acting upon its weight Wt, but since the shelf 15' is cantilevered, it will also pivot, tilt or cant in a counterclockwise direction, as is indicated by the curved line of travel A associated therewith in FIG. 6 bringing the uppermost projecting pins 60 into bearing engagement with the front leg portions 42 of the slideways 41 and the lowermost projecting supports or pins 60 into bearing engagement with the rear leg portions 43 at the slideways 41. If the slots 50 did not project into the bight portions 44 of the slideways 41, the shelf 15' would most assuredly continue a downward slide while being slightly cocked or tilted with the uppermost and lowermost projecting supports 60, 60 bearing against the respective front and rear leg portions 42, 43 of the slideways 41 until dropping out the bottom thereof. However, since the slots 50 include the ledge or edge portions 55 (FIGS. 4 and 5) which begin within the medial portion 44 of each slideway 41, the lowermost projecting supports 60 (FIG. 6) eventually reach the slots 50, devoid of the inner leg portions 43, which allows the projecting supports 60 to progressively enter horizontally aligns slots 50 guided by the transition edges 55, as is readily visualized in FIG. 6, until eventually fully overlying the transition edges 55 thereof which guide the lowermost projecting supports 60 toward and upon the horizontal supporting edges 54. Thus, the shelf 15' can be adjusted along the slideways 41 to any one of a number of vertically desired positions of adjustment absent fear of disengagement of the second shelf bracket members 27 from the first shelf bracket members 26. The latter function is extremely important because even under a worse case scenario, the shelf 15' will not drop from the first bracket members 26 and will tilt substantially no worse than that illustrated in FIG. 6 of the drawings. Even should the latter occur while articles or products are being supported upon the shelf 15', a person most likely could prevent the articles/products from falling because both hands could be utilized for the latter purpose, as opposed to being used to essentially simultaneously catch and/or hold the shelf 15' and the articles/products supported thereupon.

Another novel refrigerator shelf assembly constructed in accordance with the present invention is illustrated in FIGS. 8 through 10 of the drawings and is generally designated by the reference numeral 10". All the structure and components of the refrigerator shelf assembly 10" which are structurally identical to or equivalent to the refrigerator shelf assembly 10 of FIGS. 1 through 5 of the drawings bear the same reference numerals and reference characters but are double primed.

The refrigerator shelf assembly 10" includes a shelf 15" formed by two metal shelf supporting brackets of which only the shelf supporting bracket 17" is illustrated. A shelf member 18" of tempered glass and an injection molded encapsulation, rim or border 20" unitize the latter components which can be hooked, re-hooked and vertically adjusted relative to a first bracket member 26". Therefore, the overall shelf assembly 10" is identical to the shelf assembly 10 except that in lieu of the separate second shelf bracket member 27, the shelf bracket support 17" and the opposite equivalent unillustrated metal shelf bracket support, are each provided with a second shelf bracket member 90 which is an integral part of the shelf supporting bracket 17" (FIG. 8). The shelf bracket 17" is slit longitudinally, blanked, stamped and formed to define an upper leg 91, a medial leg 92, and a lower leg 93. The upper and lower legs 91, 93, respectively, are offset to one side of a vertical plane of the shelf bracket 17" while the medial or central leg 92 is offset an equal amount to an opposite side of a vertical plane through the shelf bracket 17" resulting in the generally U-shaped configuration when viewed from above or below (FIG. 9). The legs 91 through 93 include projecting supports or projecting pins 94 through 96, respectively. The projecting supports 94, 96 project away from and axially opposite to the direction of projection of the projecting support 95, as is most apparent from FIG. 9. The vertical spacing between the projecting supports 94, 95; 95, 96 corresponds to the vertical spacing between the slots 50" of the first shelf bracket member 26".

As in the case of the shelf 15, the shelf 15" can be inserted into the first shelf bracket member 26" from above or below by simply introducing the projecting supports 94 through 96 in the associated slideways 41", 41" (FIG. 9) and positioning the projecting supports 94 through 96 in three desired slots 50", as is illustrated in FIG. 10. Structurally and functionally the shelf assemblies 10, 10' are virtually identical except for the fact that by constructing the shelf support 17" and the second shelf bracket member 90 as a single one-piece component from a single piece of metallic material, the overall expense of manufacture of the shelf assembly 10" is appreciably lessened as compared to that of the shelf assembly 10.

Another shelf assembly constructed in accordance with this invention is illustrated in FIGS. 11 through 13 of the drawings and is generally designated by the reference numeral 100. The shelf assembly 100 is similar in structure and is substantially identical in function to the shelf assembly 10 and at each of two rear corners (unnumbered) of an injection molded encapsulation, border or rim 120, there is a second shelf bracket member 127 which is substantially identical to the second shelf bracket member 27 (FIG. 3) and functions in the manner heretofore described with respect to an associated one of a pair of first shelf bracket members 26 to adjust the shelf 150 vertically in a refrigerator compartment. The shelf assembly 100 differs from the shelf assembly 10 in that the shelf 150 excludes metallic shelf brackets corresponding to the shelf brackets 16, 17, and in lieu thereof the injection molded encapsulation, border or rim 120 integrally unitizes or unites a shelf member 118 of tempered glass to the second shelf bracket member 127 at each of the two rear corners of the rim 120 during the injection molding of the rim 120 which causes the injection molded polymeric/copolymeric material thereof to fuse across a plurality of slots 181 through 183 (FIG. 13). With one of the second shelf bracket members 127 at each corner of the shelf 150, oppositely directed projections 160 thereof function with respect to slideways 41 and slots 50 of associated first shelf bracket members 26 in the manner heretofore described relative to the shelf assembly 10.

Figure 14:
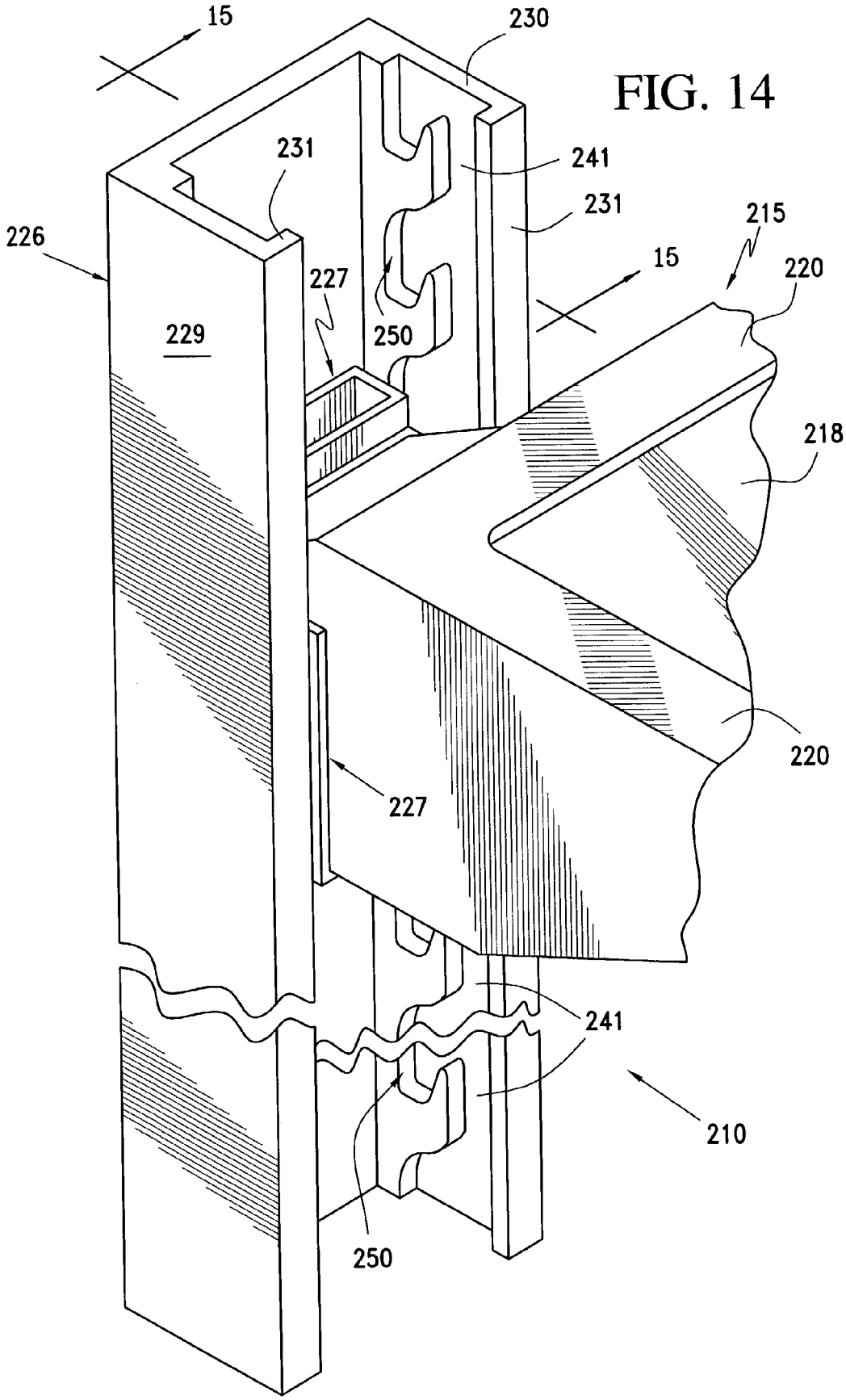
FIG. 14 is an enlarged fragmentary perspective view of another shelf adapter bracket, and illustrates a first shelf bracket member having opposing channels or slideways and vertically spaced slots and a second shelf bracket member locked thereto and supporting a shelf.
Figure 15:
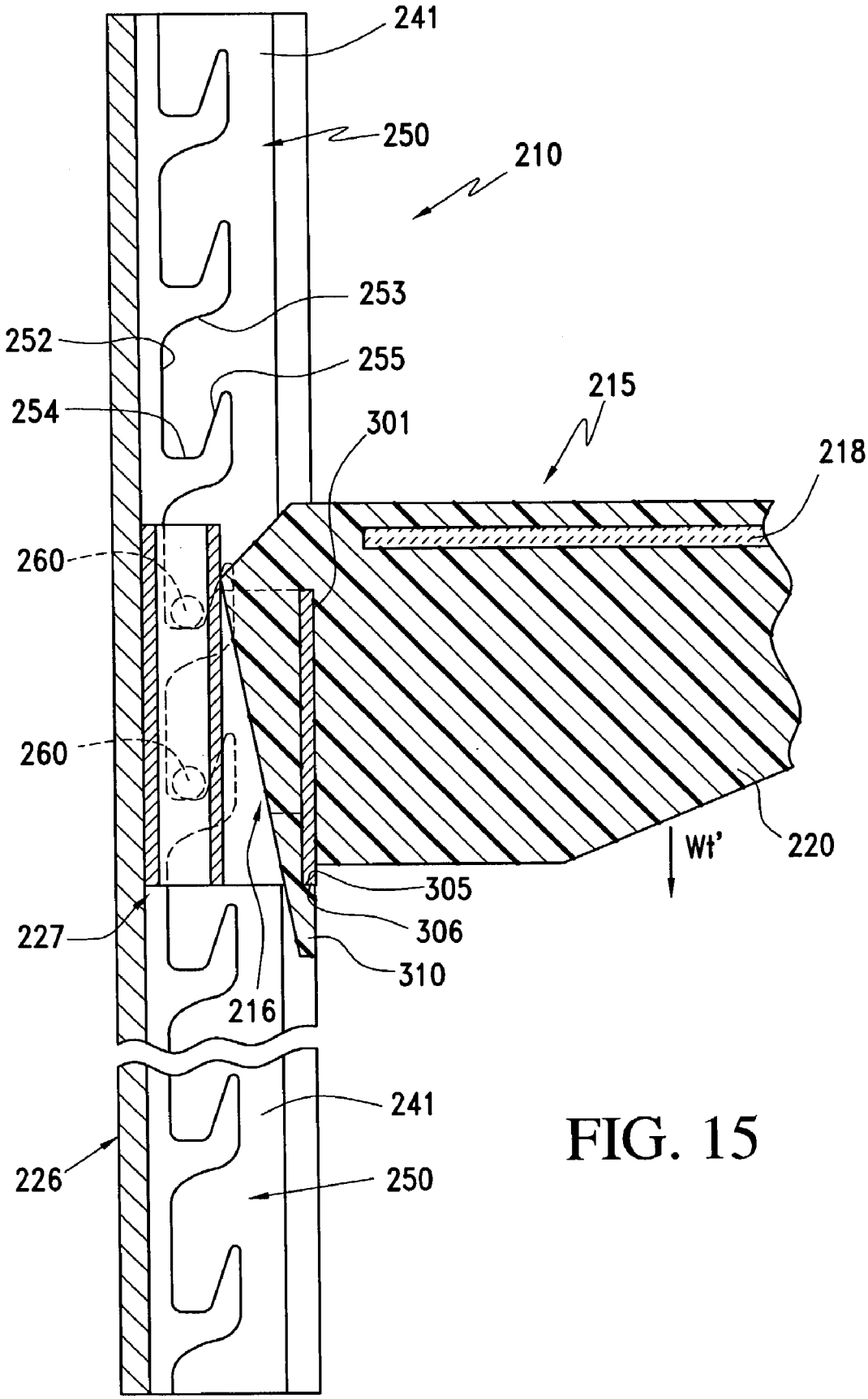
FIG. 15 is a vertical cross-sectional view taken generally along line 15—15 of FIG. 14, and illustrates the interlocked relationship between the first and second shelf bracket members, and integral hooks of a shelf carried by one of the second shelf bracket members.
Figure 16:
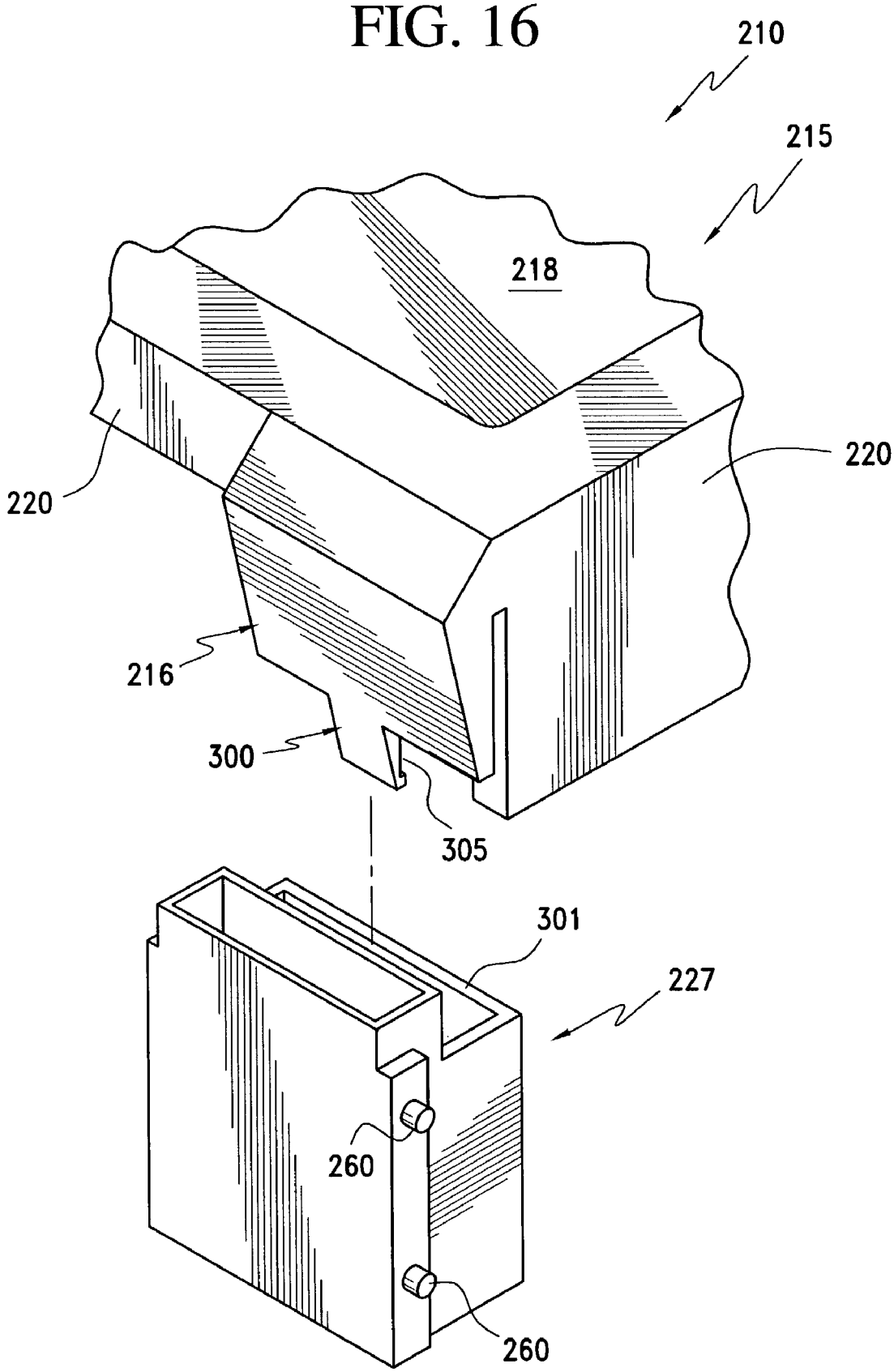
FIG. 16 is a fragmentary exploded view of the shelf and second shelf bracket member of FIGS. 14 and 15, and illustrates details thereof.

A final novel refrigerator shelf assembly constructed in accordance with the invention is illustrated in FIGS. 14 through 16 of the drawings and is generally designated by the reference numeral 210. Structure of the shelf assembly 210 which is structurally or functionally equivalent to the shelf assembly 10 is identified by identical reference numerals preceded by 200, such as a shelf 215 defined by a shelf member 218 of tempered glass which is encapsulated along a peripheral edge (unnumbered) thereof by an injection molded encapsulation, rim or border 220 which at opposite rear corners (unnumbered) includes downwardly directed relatively rigid integral hooks 216, each of which includes a centrally located, downwardly projecting, thinner flexible latching or locking tab 300 having a locking ledge 305 and a finger/thumb tab 310 (FIG. 15). Each hook 216 hooks over and behind a front wall 301 of a second shelf bracket member 227 constructed from molded polymeric/copolymeric synthetic plastic material. Each of the two second shelf bracket members 227, of which only one is illustrated, is adapted for introduction into and can be vertically adjusted relative to a first shelf bracket member 226 (FIG. 14) also constructed from synthetic polymeric/copolymeric plastic material. Each second shelf bracket member 227 includes a pair of vertically spaced oppositely directed projecting supports or supporting pins 260 (FIGS. 15 and 16) which slide in associated slideways 241 (FIGS. 14 and 15) which open toward each other in opposite legs 229, 230 (FIG. 14) of each first shelf bracket member 226. Each leg 229, 230 includes a front edge or front flange 231 with the flanges 231, 231 being in opposing relationship to each other and in part each defining one of the slideways 241 which extend the entire vertical length of the first shelf bracket member 226. Each of the legs 229, 230 is molded to define a plurality of slots 250 having surfaces, edges and/or ledges corresponding to like structure of each slot 50 which has been identified by reference numerals 252 through 255. The projecting supports 260 of each second shelf bracket member 227 cooperate with the slots 250 of each of the two first shelf bracket members 226, 226 precisely in the manner set forth with respect to the operation of the respective first and second shelf bracket members 26, 27 of the two pair of adapter brackets 25 heretofore described relative to FIGS. 1 through 7 of the drawings which are incorporated hereat by reference. Obviously, a major difference between the latter two constructions is that the slots 50 are "open," i.e., pass through the legs 29, 30 whereas the slots 250 are "closed," i.e., do not pass through the legs 229, 230. The latter may at times be considered preferable for aesthetic purposes inasmuch as the slots 250 are essentially hidden by the legs 229, 231. Furthermore, the outer surfaces (unnumbered) of the legs 229, 230 of the first shelf bracket member 226 are relatively flat and uniplanar which might also be considered to be more aesthetic than the undulating exterior configuration of the legs 29, 30, particularly in the area of the slideways 41 thereof. However, both shelf assemblies 10, 210 function identically with respect to vertical adjustment and the prevention of inadvertent or accidental shelf droppage in the manner heretofore described with respect to the shelf 15' of FIGS. 6 and 7. In the case of the shelf 215, should the latter tend to pivot, tilt or cant clockwise under its weight Wt', as viewed in FIGS. 14 and 15, when the projecting supports or pins 260 are in the slideways 241, the upper projecting supports or pins 260 will contact the front flanges 231, 231 of the legs 229, 230 which limit the tilting of the shelf 215 and the eventual introduction of the lowermost projecting supports or pins 260 into the slots 250 to achieve the orientation of the shelf 215 corresponding to the shelf 15' of FIG. 6.

After each hook 216 of the shelf 215 has been hooked upon the front wall 301 of the associated second shelf bracket member 227, the locking nose or ledge 305 of each locking tab 300 engages beneath and locks with a lower edge 306 of each second shelf bracket member 227 to prevent the shelf 215 from being inadvertently or accidentally withdrawn or removed from the second shelf bracket members 227, as is readily apparent from FIG. 15. The locking function is achieved by simply sliding each hook 216 downwardly into each second bracket member 227 which automatically prevents disengagement therebetween until desired by a person pushing the finger/thumb tabs 310 to the left, as viewed in FIG. 15, to effect disengagement of the hooks 216, 216 from the walls 301, 301 of the second shelf bracket members 227, 227.

Although a preferred embodiment of the invention has been specifically illustrated and described herein, it is to be understood that minor variations may be made in the apparatus without departing from the spirit and scope of the invention, as defined by the appended claims.

What is claimed is:

1. A vertically adjustable shelf comprising at least first and second members disposed in substantially vertically sliding relationship to each other, said first member having a pair of substantially vertically disposed slideways defining a first distance therebetween, said first member further including a plurality of substantially vertically spaced supports opening into each of said slideways, a second effective length between the spaced supports of opposite slideways defining a second effective distance different than said first distance, said second member having at least a pair of supports, a third effective distance between said second member pair of supports which is between said first and second distances wherein (a) said first and second members are relatively vertically slidable when said second member pair of supports are disposed within said slideways and (b) said first and second members are relatively vertically nonslidable when said second member pair of supports are disposed upon said first member supports, and a shelf carried by one of said first and second members.

2. The vertically adjustable shelf as defined in claim 1 wherein said second member pair of supports project toward each other.

3. The vertically adjustable shelf as defined in claim 1 wherein said second member pair of supports project away from each other.

4. The vertically adjustable shelf as defined in claim 1 wherein said first member includes a pair of side walls each of which includes one of said pair of slideways.

5. The vertically adjustable shelf as defined in claim 1 wherein said first member is substantially channel-shaped in transverse cross section, said channel-shaped member includes a pair of side walls, and each side wall includes one of said pair of slideways.

6. The vertically adjustable shelf as defined in claim 1 wherein said shelf includes a glass panel at least partially bordered by a frame of plastic material.

7. The vertically adjustable shelf as defined in claim 1 wherein said shelf includes a glass panel integrally united to one of said first and second members by an injection molded encapsulation of plastic material.

8. The vertically adjustable shelf as defined in claim 1 wherein said shelf includes a glass panel integrally united to one of said first and second members by an injection molded encapsulation of plastic material, and said one member is formed by the plastic material of the encapsulation.

9. The vertically adjustable shelf as defined in claim 1 wherein said shelf includes a shelf bracket carrying a shelf panel, and means for connecting said shelf bracket to one of said first and second members.

10. The vertically adjustable shelf as defined in claim 1 wherein said shelf includes a shelf bracket carrying a shelf panel, and one of slot and hook means for connecting said shelf bracket to one of said first and second members.

11. The vertically adjustable shelf as defined in claim 1 wherein said shelf includes a shelf bracket carrying a shelf panel, and injection molded means for connecting said shelf bracket to one of said first and second members.

12. The vertically adjustable shelf as defined in claim 1 wherein said shelf includes a shelf bracket carrying a shelf panel, and said shelf bracket is an integral portion of one of said first and second members.

13. The vertically adjustable shelf as defined in claim 1 wherein said shelf includes a shelf bracket carrying a shelf panel, and said shelf bracket is an integral metal portion of one of said first and second members.

14. The vertically adjustable shelf as defined in claim 1 wherein said shelf includes a shelf bracket carrying a shelf panel, and said shelf bracket is an integral plastic portion of one of said first and second members.

15. The vertically adjustable shelf as defined in claim 1 wherein said shelf includes a shelf bracket carrying a shelf panel, and said shelf bracket and one of said first and second members is a single molded member of plastic material.

16. The vertically adjustable shelf as defined in claim 1 wherein said shelf includes a shelf bracket carrying a shelf panel, and said shelf bracket and one of said first and second members is a single injection molded member of plastic material.

17. The vertically adjustable shelf as defined in claim 1 wherein said shelf includes a shelf bracket carrying a shelf panel, and said shelf bracket and one of said first and second members is a single injection molded member of plastic material in at least partial encapsulating relationship to a peripheral edge of said shelf panel.

18. The vertically adjustable shelf as defined in claim 1 wherein said shelf includes a shelf bracket carrying a glass shelf panel, and said shelf bracket and one of said first and second members is a single injection molded member of plastic material in at least partial encapsulating relationship to a peripheral edge of said glass shelf panel.

19. The vertically adjustable shelf as defined in claim 1 wherein said first member is substantially channel-shaped in transverse cross section, and said channel-shaped member includes a pair of side walls, each side wall includes a slideway, and said second member pair of supports are movable between an associated first member pair of slideways and pair of supports.

20. The vertically adjustable shelf as defined in claim 1 wherein said first member is a generally U-shaped channel defined by a pair of side walls and a bight wall therebetween, each side wall includes one of said pair of slideways, said slideways open toward each other, said second member pair of supports project in opposite directions, and each second member support projects toward and is slidable in an associated one of said slideways.

21. The vertically adjustable shelf as defined in claim 1 wherein said first member is a generally U-shaped channel defined by a pair of side walls and a bight wall therebetween, each side wall includes one of said pair of slideways, said slideways open away from each other, said second member pair of supports project in opposite directions, and each second member support projects toward and is slidable in an associated one of said slideways.

22. The vertically adjustable shelf as defined in claim 20 wherein said shelf is carried by said second member.

23. The vertically adjustable shelf as defined in claim 20 wherein said shelf is removably connected to said second member.

24. The vertically adjustable shelf as defined in claim 20 wherein said shelf is removably connected to said second member through a hook and slot connection.

25. The vertically adjustable shelf as defined in claim 20 wherein said shelf includes a substantially planar panel, and polymeric means for uniting said planar panel to said second member.

26. The vertically adjustable shelf as defined in claim 20 wherein said second member is part of a shelf bracket of said shelf.

27. The vertically adjustable shelf as defined in claim 1 wherein said second member is made of metallic material in part defining a shelf bracket of said shelf, a substantially planar shelf member, and means for uniting said shelf bracket and said substantially planar shelf member.

28. The vertically adjustable shelf as defined in claim 1 wherein said second member is made of metallic material in part defining a shelf bracket of said shelf, a substantially planar shelf member, and polymeric means for uniting said shelf bracket and said substantially planar shelf member.

29. The vertically adjustable shelf as defined in claim 1 wherein said second member is made of a relatively thin piece of metallic material, said thin piece of metallic material including a pair of relatively spaced legs merging with a shelf bracket of said shelf, and said pair of legs include one each of said second member supports.

30. The vertically adjustable shelf as defined in claim 1 wherein said second member is made of a relatively thin piece of metallic material, said thin piece of metallic material including a pair of relatively spaced legs merging with a shelf bracket of said shelf, said pair of legs include one each of said second member supports, a substantially planar shelf member, and polymeric means for uniting said planar panel to said second member.

31. A vertically adjustable shelf comprising a pair of first and second members disposed in substantially vertical sliding relationship to each other, said first members being disposed in substantially horizontally spaced vertical relationship and each having a pair of substantially vertically disposed slideways defining a first distance therebetween, each said first member further including a plurality of substantially vertically spaced supports opening into associated slideways, a second effective length between the spaced supports of opposite slideways defining a second effective distance different than said first distance, each second member having at least a pair of supports, a third effective distance between each said second member pair of supports which is between said first and second distances wherein (a) said first and second members of each pair are relatively vertically slidable when each said second member pair of supports are disposed within said slideways and (b) said first and second members of each pair are relatively vertically nonslidable when each said second member pair of supports are disposed upon associated first member supports, and a shelf carried in spanning relationship between one of said first and second members of said pair of first and second members.

32. The vertically adjustable shelf as defined in claim 31 wherein each of second member pair of supports project toward each other.

33. The vertically adjustable shelf as defined in claim 31 wherein each said second member pair of supports project away from each other.

34. The vertically adjustable shelf as defined in claim 31 wherein each of said first members includes a pair of side walls each of which includes one of said pair of slideways.

35. The vertically adjustable shelf as defined in claim 31 wherein each of said first members is substantially channel-shaped in transverse cross section, each of said channel-shaped members includes a pair of side walls, and each side wall includes one of said pair of slideways.

36. The vertically adjustable shelf as defined in claim 31 wherein said shelf includes a glass panel at least partially bordered by a frame of plastic material.

37. The vertically adjustable shelf as defined in claim 31 wherein said shelf includes a glass panel integrally united to one of said first and second members of said pair of first and second members by an injection molded encapsulation of plastic material.

38. The vertically adjustable shelf as defined in claim 31 wherein said shelf includes a glass panel integrally united to one of said first and second members of said pair of first and second members by an injection molded encapsulation of plastic material, and each of said one member is formed by the plastic material of the encapsulation.

39. The vertically adjustable shelf as defined in claim 31 wherein said shelf includes a shelf bracket carrying a shelf panel, and means for connecting said shelf bracket to one of said first and second members of each of said pair of first and second members.

40. The vertically adjustable shelf as defined in claim 31 wherein said shelf includes a shelf bracket carrying a shelf panel, and one of slot and hook means for connecting said shelf bracket to one of said first and second members of each of said pair of first and second members.

41. The vertically adjustable shelf as defined in claim 31 wherein said shelf includes a shelf bracket carrying a shelf panel, and injection molded means for connecting said shelf bracket to one of said first and second members of each of said pair of first and second members.

42. The vertically adjustable shelf as defined in claim 31 wherein said shelf includes a bracket carrying a shelf panel, and said shelf bracket is an integral portion of one of said first and second members.

43. The vertically adjustable shelf as defined in claim 31 wherein said shelf includes a bracket carrying a shelf panel, and said shelf bracket is an integral metal portion of one of said first and second members.

44. The vertically adjustable shelf as defined in claim 31 wherein said shelf includes a bracket carrying a shelf panel, and said shelf bracket is an integral plastic portion of one of said first and second members.

45. The vertically adjustable shelf as defined in claim 31 wherein said shelf includes a shelf bracket carrying a shelf panel, and said shelf bracket and one of each of said first and second members of said pair of first and second members is a single molded member of plastic material.

46. The vertically adjustable shelf as defined in claim 31 wherein said shelf includes a shelf bracket carrying a shelf panel, and said shelf bracket and one of each of said first and second members of said pair of first and second members is a single injection molded member of plastic material.

47. The vertically adjustable shelf as defined in claim 31 wherein said shelf includes a shelf bracket carrying a shelf panel, and injection molded means for connecting said shelf bracket to one of said first and second members of each of said pair of first and second members in at least partial encapsulating relationship to a peripheral edge of said shelf panel.

48. The vertically adjustable shelf as defined in claim 31 wherein said shelf includes a shelf bracket carrying a glass shelf panel, and injection molded means for connecting said shelf bracket to one of said first and second members of each of said pair of first and second members in at least partial encapsulating relationship to a peripheral edge of said glass shelf panel.

49. The vertically adjustable shelf as defined in claim 31 wherein said first member of each of said pair of first and second members is substantially channel-shaped in transverse cross-section, each of said channel-shaped members includes a pair of side walls, each side wall includes a slideway, and each of said second member pair of supports are movable between an associated first member pair of slideways and pair of supports.

50. The vertically adjustable shelf as defined in claim 31 wherein each of said first members is a generally U-shaped channel defined by a pair of side walls and a bight wall therebetween, each side wall includes one of said pair of slideways, said slideways open toward each other, each of said second member pair of supports project in opposite directions, and each second member support projects toward and is slidable in an associated one of said slideways.

51. The vertically adjustable shelf as defined in claim 31 wherein each of said first members is a generally U-shaped channel defined by a pair of side walls and a bight wall therebetween, each side wall includes one of said pair of slideways, said slideways open away from each other, each of said second member pair of supports project in opposite directions, and each second member support projects toward and is slidable in an associated one of said slideways.

52. The vertically adjustable shelf as defined in claim 50 wherein said shelf is carried by said second members.

53. The vertically adjustable shelf as defined in claim 50 wherein said shelf is removably connected to each of said second members.

54. The vertically adjustable shelf as defined in claim 50 wherein said shelf is removably connected to each of said second members through a hook and slot connection.

55. The vertically adjustable shelf as defined in claim 50 wherein said shelf includes a substantially planar panel, and polymeric means for uniting said planar panel to said second members.

56. The vertically adjustable shelf as defined in claim 50 wherein each of said second members is part of a shelf bracket of said shelf.

57. The vertically adjustable shelf as defined in claim 31 wherein each of said second members is made of metallic material in part defining a shelf bracket of said shelf, a substantially planar shelf member, and means for uniting each of said shelf brackets and said substantially planar shelf member.

58. The vertically adjustable shelf as defined in claim 31 wherein each of said second members is made of metallic material in part defining a shelf bracket of said shelf, a substantially planar shelf member, and polymeric means for uniting each of said shelf brackets and said substantially planar shelf member.

59. The vertically adjustable shelf as defined in claim 31 wherein each of said second members is made of a relatively thin piece of metallic material, each of said thin pieces of metallic material including a pair of relatively spaced legs merging with a shelf bracket of said shelf, and each of said pair of legs include one each of said second member supports.

60. The vertically adjustable shelf as defined in claim 31 wherein each of said second members is made of a relatively thin piece of metallic material, each of said thin pieces of metallic material including a pair of relatively spaced legs merging with a shelf bracket of said shelf, each of said pair of legs include one each of said second member supports, a substantially planar shelf member, and polymeric means for uniting each of said shelf brackets and said substantially planar shelf member.

* * * * *